US011158470B2

(12) United States Patent
Yen et al.

(10) Patent No.: US 11,158,470 B2
(45) Date of Patent: Oct. 26, 2021

(54) LUMINOUS KEY

(71) Applicants: LITE-ON ELECTRONICS (GUANGZHOU) LIMITED, Guangzhou (CN); Lite-On Technology Corporation, Taipei (TW)

(72) Inventors: Ming-Fu Yen, Taipei (TW); Hsiang-Sheng Chuang, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 16/667,928

(22) Filed: Oct. 30, 2019

(65) Prior Publication Data

US 2020/0365350 A1 Nov. 19, 2020

(30) Foreign Application Priority Data

May 15, 2019 (CN) ..... 201910404871.2

(51) Int. Cl.
*H01H 13/83* (2006.01)

(52) U.S. Cl.
CPC ..... *H01H 13/83* (2013.01)

(58) Field of Classification Search
CPC ..... H01H 13/83
See application file for complete search history.

(56) References Cited

U.S. PATENT DOCUMENTS 4,423,299 A * 12/1983 Gurol ..... H01H 13/83 200/5 A
2019/0056794 A1* 2/2019 Goldberg ..... G06F 3/0202
(Continued)

FOREIGN PATENT DOCUMENTS

CN 201421028 3/2010
CN 201570410 9/2010
(Continued)

OTHER PUBLICATIONS

Office Action of China Counterpart Application, dated Mar. 16, 2020, p. 1-p. 8.
(Continued)

*Primary Examiner* — Matthew J. Peerce
(74) *Attorney, Agent, or Firm* — JCIPRNET

(57) ABSTRACT

A luminous key comprises a key cap, a bottom plate, a first circuit component and a second circuit component. The key cap comprises a body, an extension part and a light exiting part. The extension part is disposed at the periphery of the body. The light exiting part is disposed on the body. The bottom plate has a through hole. The first circuit component has a first layer, a second layer and a light emitting unit. The first layer is disposed on the second layer. The light emitting unit is disposed between the first layer and the second layer, and the light emitting unit is corresponding to the through hole. The second circuit component is disposed between the key cap and the bottom plate. A lifting structure is disposed between the key cap and the bottom plate. Light adjusting structures define a light adjusting region. An orthographic projection of the light adjusting region towards the second layer covers at least a portion of the light emitting unit.

7 Claims, 10 Drawing Sheets

(56) References Cited

U.S. PATENT DOCUMENTS

| | | | | |
|---|---|---|---|---|
| 2019/0122835 | A1* | 4/2019 | Pan | H01H 3/125 |
| 2019/0172662 | A1* | 6/2019 | Chiang | H01H 13/705 |
| 2019/0228932 | A1* | 7/2019 | Lin | H01H 13/705 |

FOREIGN PATENT DOCUMENTS

| | | |
|---|---|---|
| CN | 201717158 | 1/2011 |
| CN | 201936257 | 8/2011 |
| CN | 202189712 | 4/2012 |
| CN | 202217608 | 5/2012 |
| CN | 103151206 | 6/2013 |
| CN | 204720362 | 10/2015 |
| CN | 105448568 | 3/2016 |
| CN | 107993868 | 5/2018 |
| CN | 109148196 | 1/2019 |
| JP | H05101737 | 4/1993 |

OTHER PUBLICATIONS

"Office Action of China Counterpart Application", dated Jun. 23, 2020, p. 1-p. 8.
"Office Action of China Counterpart Application", dated May 24, 2021, p. 1-p. 7.

* cited by examiner

LUMINOUS KEY

CROSS-REFERENCE TO RELATED APPLICATION

This application claims the priority benefit of Chinese patent application serial no. 201910404871.2, filed on May 15, 2019. The entirety of the above-mentioned patent application is hereby incorporated by reference herein and made a part of this specification.

BACKGROUND OF THE INVENTION

1. Field of the Invention

The present invention relates to a key and particularly relates to a luminous key.

2. Description of Related Art

With the popularity of computers, the computers may be used in various environments. For example, if a computer is used in a weaker light environment, a user has difficulty in identifying the numbers or characters marked on a keyboard, thereby causing difficult operation.

The development of a luminous keyboard helps the user to use in insufficient light environments.

In a general luminous keyboard, because a lifting structure is disposed inside a luminous key, in order to enable the luminous key to display the marked number or character after penetrating through the lifting structure, the luminous component in the luminous key needs to emit stronger light beams to allow the user to identify a luminous pattern. However, gaps exist around the key structure, and excessively powerful light beams will be emitted from the gaps, thereby causing a phenomenon of lateral light leakage and affecting the use of the user.

SUMMARY OF THE INVENTION

The present invention provides a luminous key capable of effectively improving the phenomenon of lateral light leakage.

An embodiment of the present invention provides a luminous key, which comprises a key cap, a bottom plate, a first circuit component and a second circuit component. The key cap comprises a body, an extension part and a light exiting part. The extension part is disposed at the periphery of the body. The light exiting part is disposed on the body. The bottom plate has a through hole. The first circuit component has a first layer, a second layer and a light emitting unit. The first layer is disposed on the second layer. The light emitting unit is disposed between the first layer and the second layer, and the light emitting unit is corresponding to the through hole. The second circuit component is disposed between the key cap and the bottom plate. A lifting structure is disposed between the key cap and the bottom plate. Light adjusting structures define a light adjusting region. An orthographic projection of the light adjusting region towards the second layer covers at least a portion of the light emitting unit.

In an embodiment of the present invention, the light adjusting structures are a plurality of screen dots structures, and the thicknesses of the screen dots structures are in a range from 3 microns to 30 microns.

In an embodiment of the present invention, the light adjusting structures are disposed at the first layer of the first circuit component.

In an embodiment of the present invention, the light adjusting structures are disposed on the second circuit component.

In an embodiment of the present invention, the orthographic projection of the light exiting part towards the second layer does not cover the light emitting unit.

In an embodiment of the present invention, the second layer has a first surface and a second surface which are opposite to each other, the light emitting unit is disposed on the first surface, and an opaque material is disposed on the second surface.

In an embodiment of the present invention, the first surface has a concave part, and the light emitting unit is disposed in the concave part.

In an embodiment of the present invention, the luminous key further comprises a frame body and an elastic part. The frame body is disposed on the second circuit component. The elastic part is disposed between the key cap and the second circuit component. When the luminous key is not pressed, a distance between a bottom surface of the extension part and the second circuit component is less than or equal to the thickness of the frame body.

In an embodiment of the present invention, the light emitting unit is located in an orthographic projection range of the elastic part towards the second layer.

In an embodiment of the present invention, the plurality of light adjusting structures are disposed on the elastic part.

Based on the above, in the luminous key according to the embodiments of the present invention, the plurality of light adjusting structures defines the light adjusting region, and the orthographic projection of the light adjusting region at the second layer covers at least a portion of the light emitting unit, so that the light adjusting structures can effectively reduce the intensity of the light beams emitted by the luminous component so as to correspondingly reduce the intensity of the light beams emitted from gaps and effectively improve the phenomenon of lateral light leakage. Furthermore, the light adjusting structures can also ensure that the light beam with certain intensity is emitted from the light exiting part, and therefore the luminous key and a keyboard according to the embodiments of the present invention can provide good use experience for users.

To make the foregoing features and advantages of the present application more comprehensible, exemplary embodiments are described below in detail with reference to the accompanying drawings.

DESCRIPTION OF THE EMBODIMENTS

Figure 1:
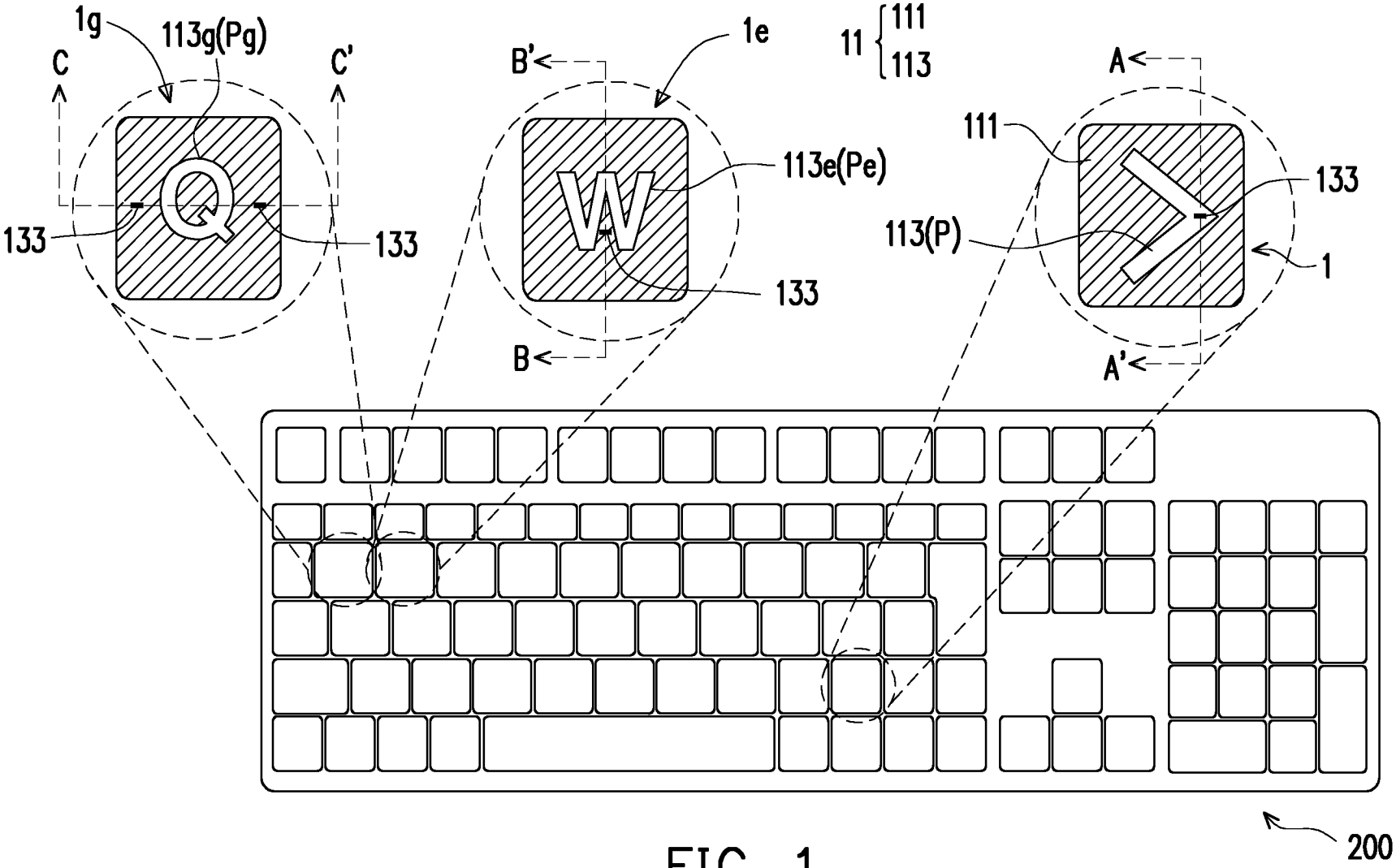
FIG. 1 is a top view of a keyboard using a luminous key according to an embodiment of the present invention.

FIG. 1 is a top view of a keyboard using a luminous key according to an embodiment of the present invention. FIG.

Figure 2A:
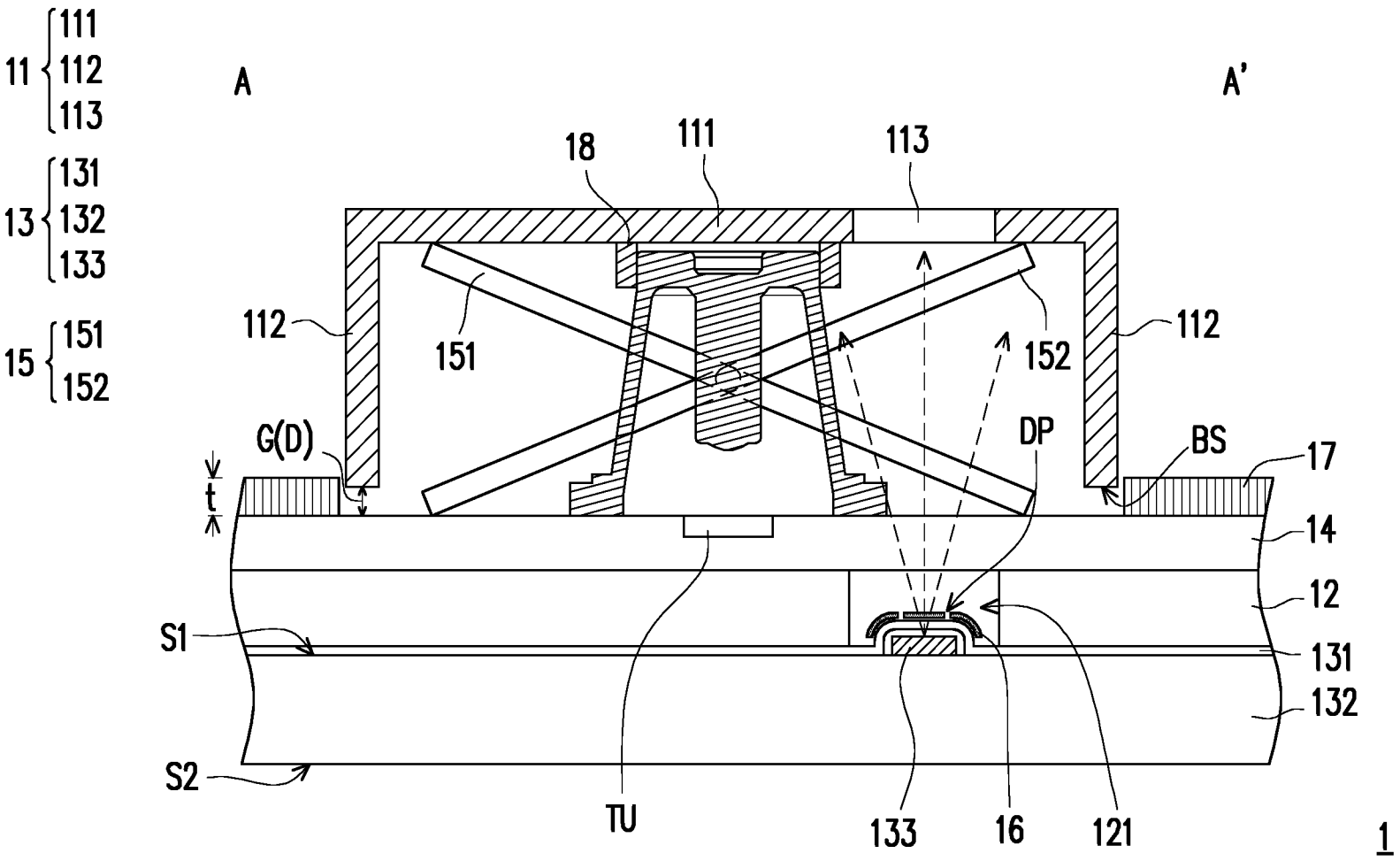
FIG. 2A to FIG. 2D are cross-sectional views of luminous keys according to some embodiments of the present invention.
Figure 2B:
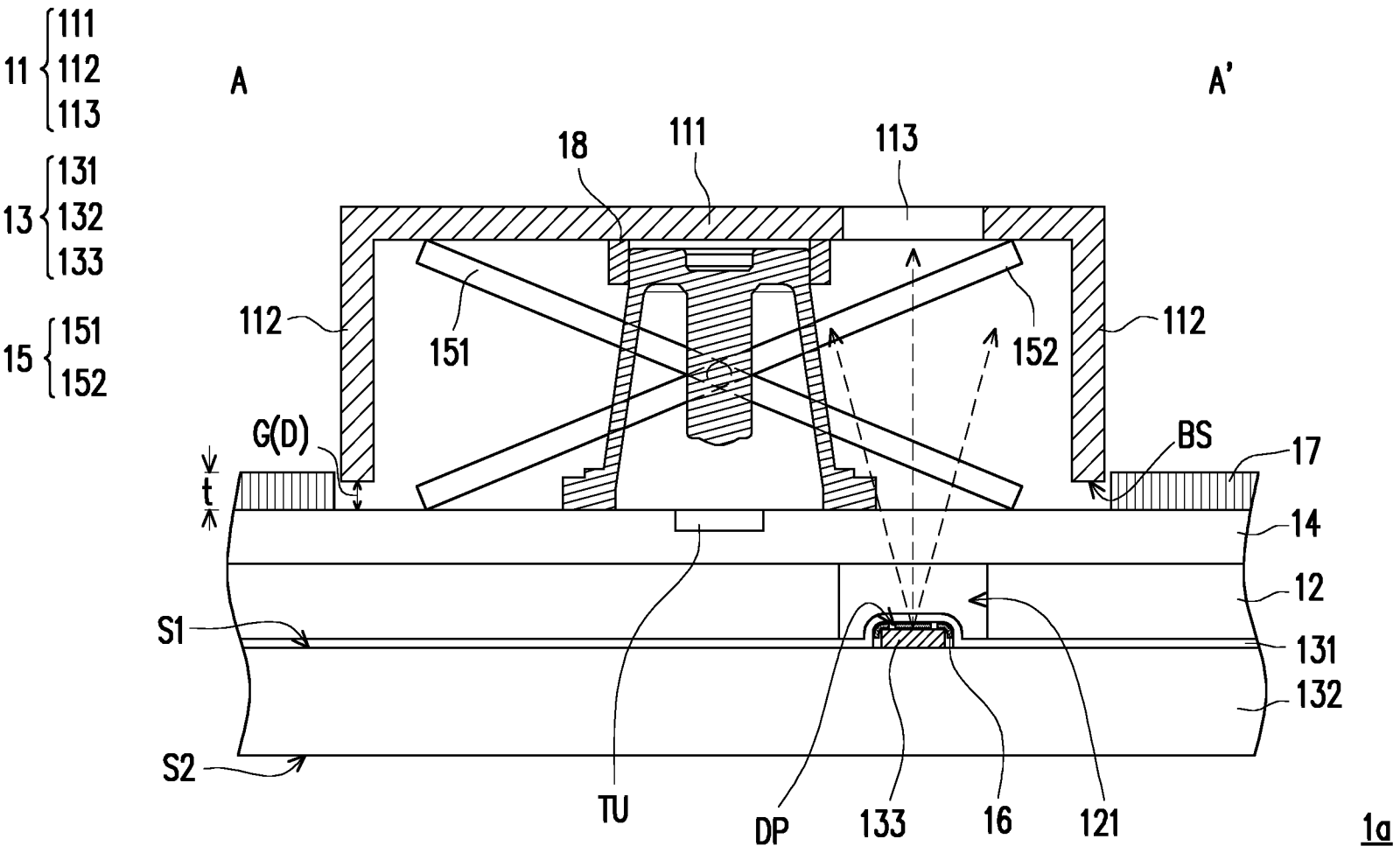
Figure 2C:
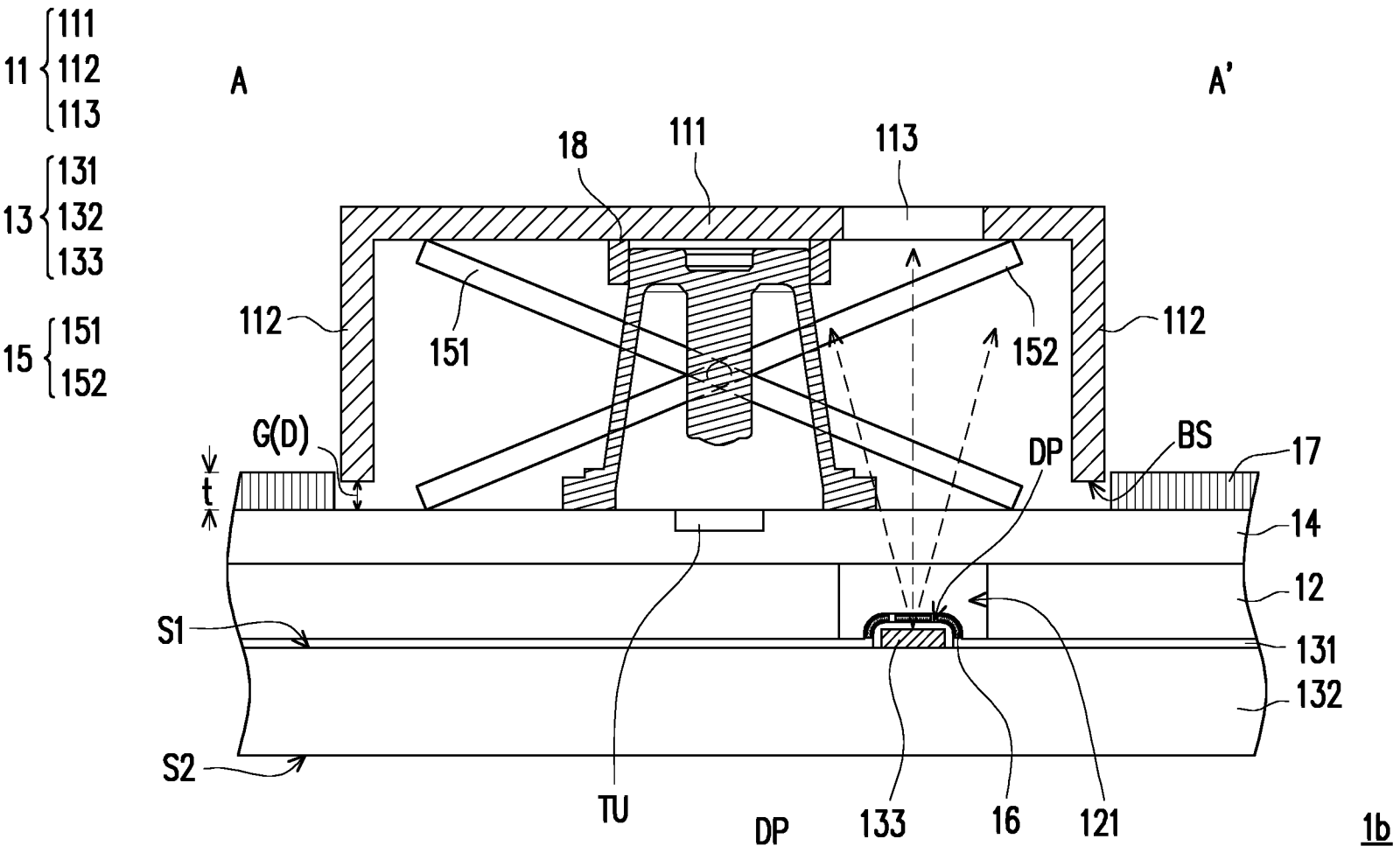
Figure 2D:
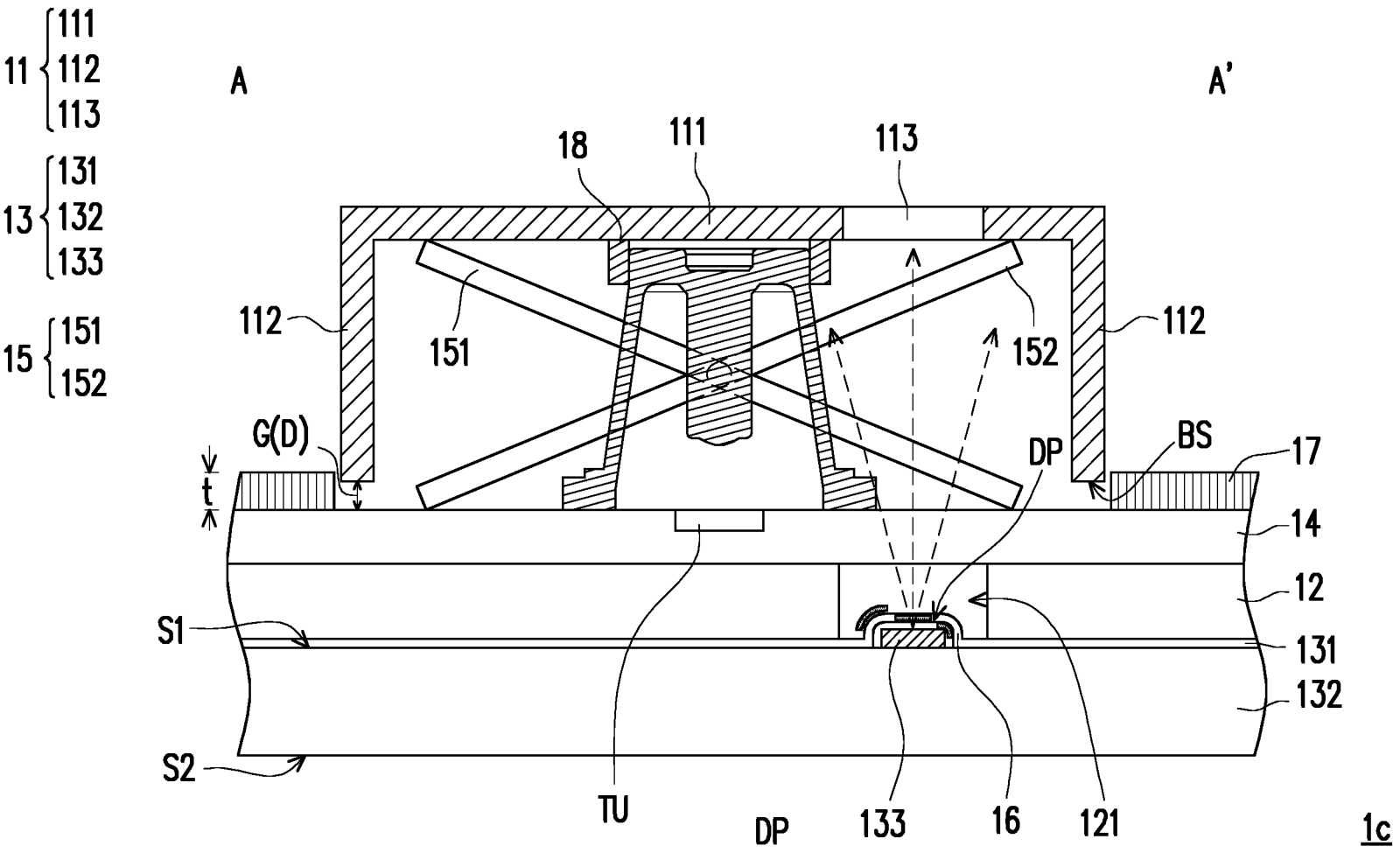
Figure 3B:
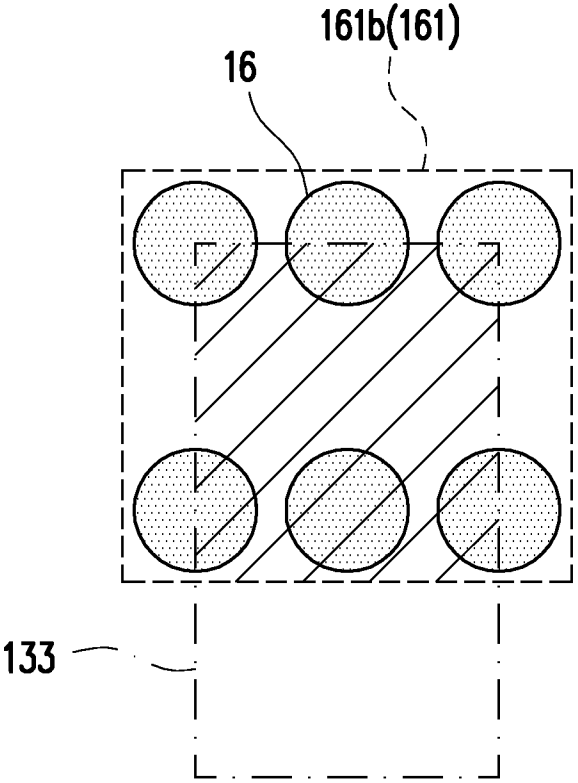
FIG. 3A and FIG. 3B are configuration views of light adjusting structures, light adjusting regions and light emitting units of luminous keys according to some embodiments of the present invention.
Figure 3A:
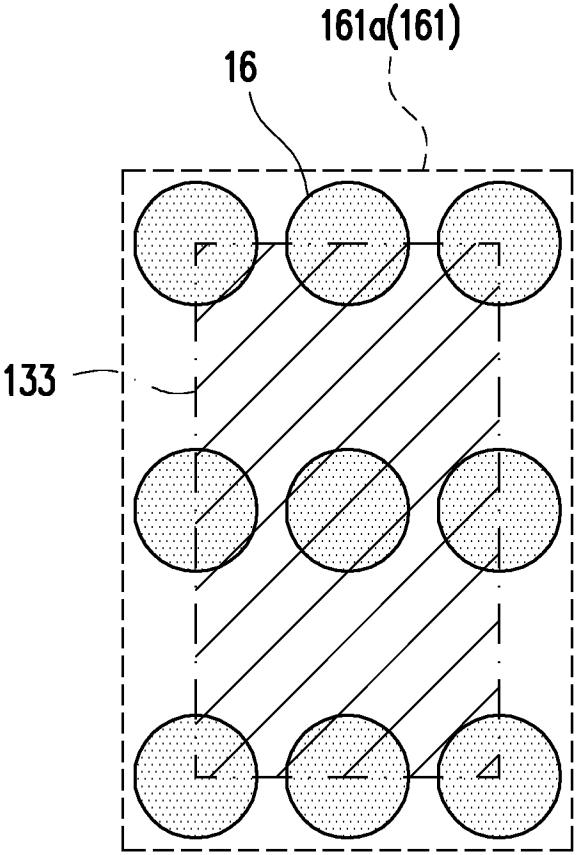

2A to FIG. 2D are cross-sectional views of luminous keys according to some embodiments of the present invention. FIG. 3A and FIG. 3B are configuration views of light adjusting structures, light adjusting regions and light emitting units.

Referring to FIG. 1 and FIG. 2A, a plurality of keys in a keyboard 200 at least comprises a luminous key 1 according to an embodiment of the present invention. In the embodiment, the luminous key 1 includes a key cap 11, a bottom plate 12, a first circuit component 13, a second circuit component 14, a lifting structure 15, a plurality of light adjusting structures 16, a frame body 17 and an elastic part 18. The configuration between every two components is described in detail in the following paragraphs.

The key cap 11 includes a body 111, an extension part 112 and a light exiting part 113. The extension part 112 is disposed at the periphery of the body 111 and extends from the periphery of the body 111 to the direction of the bottom plate 12, and the light exiting part 113 is disposed on the body 111. In the embodiment, the body 111 and the extension part 112 are made of opaque materials and have a masking effect, and the light exiting part 113 is made of a light-transmitting material and has a light-transmitting effect. For example, the light exiting part 113 forms a character, a number or a symbol marked on the key. As shown in FIG. 1, in the luminous key 1, for example, a pattern P formed by the light exiting part 113 includes a symbol ">", but the present invention is not limited thereto.

The bottom plate 12 has a through hole 121, and the bottom plate 12 is disposed between the first circuit component 13 and the second circuit component 14.

The first circuit component 13 has a first layer 131, a second layer 132 and a light emitting unit 133. The second layer 132 has a first surface S1 and a second surface S2 (upper and lower surfaces) which are opposite to each other, wherein the first surface S1 faces towards the key cap 11, and an opaque material (not shown) is disposed on the second surface S2. In the embodiment, the first layer 131 is disposed on the second layer 132, the light emitting unit 133 is disposed between the first layer 131 and the second layer 132, and the light emitting unit 133 is disposed corresponding to the through hole 121 of the bottom plate 12. In detail, the light emitting unit 133 is disposed on the first surface S1 of the second layer 132, and the first layer 131 is attached to the first surface S1 of the second layer 132 and covers the light emitting unit 133. Herein, the light emitting unit 133 is disposed in the through hole 121 of the bottom plate 12. The first layer 131 is made of a light-transmitting material, such as polyethylene terephthalate (PET), but the present invention is not limited thereto. Furthermore, in the embodiment, an orthographic projection of the light exiting part 113 covers the light emitting unit 133, but the present invention is not limited thereto.

Furthermore, the light emitting unit 133 can be a light emitting diode (LED), a mini light emitting diode (mini LED), a micro light emitting diode (micro LED), an organic light emitting diode (OLED), or other light emitting components with light emitting functions, but the present invention is not limited thereto. In the embodiments of the present invention, the size of the mini light emitting diode can be in a range from 100 microns to 200 microns, the size of the micro light emitting diode can be in a micron level and is less than 100 microns and greater than 0 micron, and the size of the light emitting diode can be greater than 200 microns. The present invention is not limited thereto.

The second circuit component 14 is disposed between the key cap 11 and the bottom plate 12. In the embodiment, the second circuit component 14 is a multi-layer structure, such as a three-layer structure, and the second circuit component 14 includes a plurality of trigger units TU (one trigger unit is shown as an example) and a circuit layout (not shown), wherein each trigger unit TU is disposed corresponding to the key cap 11.

The lifting structure 15 is disposed between the key cap 11 and the bottom plate 12. In the embodiment, the lifting structure 15 includes a first support element 151 and a second support element 152, one side of each of the first support element 151 and the second support element 152 is connected with the joint part of the bottom of the key cap 11 in a fixed or slidable way, and the other sides of the first support element 151 and the second support element 152 are connected with the joint part of the bottom plate 12 in a fixed or slidable way. Herein, for example, the first support element 151 and the second support element 152 are pivotally connected to each other. In other embodiments, the first support element 151 and the second support element 152 are respectively connected with the key cap 11 and the bottom plate 12 and are not pivotally connected to each other. In addition, it is worth mentioning that the joint part of the bottom plate 12 and the bottom plate 12 can be processed by the same sheet, so that the bottom plate 12 and the joint part thereof are made of the same material. Or, the joint part of the bottom plate 12 is formed on the bottom plate 12 by means of injection molding or in-mold forming, so that the bottom plate 12 and the joint part thereof are made of different materials.

Referring to FIG. 3A and FIG. 3B, a plurality of light adjusting structures 16 defines a light adjusting region 161, wherein the light adjusting region 161 can be defined as a minimum region covering all the light adjusting structures 16. For example, in FIG. 3A, a light adjusting region 161*a* is an externally tangent rectangle tangential to eight light adjusting structures 16 positioned outside. In FIG. 3B, a light adjusting region 161*b* is an externally tangent rectangle tangential to all (six) light adjusting structures 16. A layout mode shown in FIG. 3A or FIG. 3B can be adopted for the light adjusting structures 16. In summary, an orthographic projection of the light adjusting region 161 towards the second layer 132 of the first circuit component 13 covers at least a portion of the light emitting unit 133. Specifically, in FIG. 3A, the orthographic projection of the light adjusting region 161 towards the second layer 132 covers the whole light emitting unit 121; in FIG. 3B, the orthographic projection of the light adjusting region 161 towards the second layer 132 covers a portion of the light emitting unit 133; the other portion of the orthographic projection does not cover the light emitting unit 133; and an oblique line region in each of FIG. 3A and FIG. 3B is an overlapped portion of the light emitting unit 133 and the orthographic projection of the light adjusting region 161 towards the second layer 132. Therefore, by means of the above layout mode, the light adjusting structures 16 are disposed on a transmission path of at least a portion of the light beams emitted by the light emitting unit 133, and then, the light beams can be adjusted by the light adjusting structures 16. Herein, a light adjusting structure 140 can be a screen dot structure DP with an optical property of adjusting the light beams emitted by the light emitting unit 133. In the embodiments of FIG. 3A and FIG. 3B, nine and six light adjusting structures 16 are respectively used for forming the light adjusting region 161*a* and the light adjusting region 161*b*, and each light adjusting structure 16 has the same area substantially. However, the present invention is not limited thereto. In other words, the quantity of the light adjusting structures 16, the area of each light adjusting structure 16, the size relation between every two light adjusting structures 16 and the thickness of each light adjusting structure 16 can be designed differently according to the requirement of brightness.

The light adjusting structures 16 can be made of reflective paint or opaque materials, and the thicknesses of the light adjusting structures 16 are in a range from 3 microns to 30 microns. Under this condition, the light adjusting structures 16 can reflect or absorb a portion of light beams emitted by the light emitting unit 133, thereby reducing the intensity of the light beams emitted by the light adjusting structures 16, and scattering the light beams emitted by the light emitting unit 133 so as to reduce the concentration degree of the light beams. In the embodiment, the light adjusting structures 16 are disposed at the first layer 131 of the first circuit component 13. In detail, as shown in FIG. 2A to FIG. 2D, the light adjusting structures 16 can be disposed on the upper surface of the first layer 131 (as shown in FIG. 2A), namely one side surface away from the light emitting unit 133 of the first layer 131, or on the lower surface of the first layer 131 (as shown in FIG. 2B), namely one side surface adjacent to the light emitting unit 133 of the first layer 131, or in the first layer 131 (as shown in FIG. 2C), or in any combined foregoing position (as shown in FIG. 2D). The present invention is not limited thereto.

Referring to FIG. 2A, the frame body 17 is disposed on the second circuit component 14 and can be disposed on the upper surface of the second circuit component 14. The material of the frame body 17 can be metal or plastic but is not limited thereto. As shown in FIG. 2A, when the luminous key 1 is not pressed, the distance D between a bottom surface BS of the extension part 112 and the second circuit component is less than or equal to the thickness of the frame body 17.

The elastic part 18 generally refers to a component with elasticity. In the embodiment, the elastic part 18 can be a rubber dome. In some embodiments, the elastic part 18 can be a metal compression spring. The present invention is not limited thereto. Referring to FIG. 2A, the elastic part 18 is disposed between the key cap 11 and the second circuit component 14, and two ends of the elastic part 18 are respectively abutted with the second circuit component 14 and the key cap 11. When a user presses the key cap 11, the elastic part 18 is driven to generate downward deformation to press the trigger unit TU, the trigger unit TU is correspondingly pressed and deformed to generate an electric signal, and the electric signal is transmitted by means of the circuit layout of the second circuit component 14. When the user does not press the key cap 11, the elastic part 18 restores elasticity and is away from the trigger unit TU.

The optical effects of the luminous key 100 of the present embodiment will be described in detail in the following paragraphs.

Taking FIG. 2A as an illustrative example, when the luminous component 133 is controlled by the first circuit component 13 to emit light beams, at least a portion of light beams sequentially penetrate through the first layer 131, the light adjusting structures 16, the second circuit component 14 and the lifting structure 15, then are transmitted to the light exiting part 113, and are emitted via the light exiting part 113. Therefore, the pattern P of the light exiting part 113 becomes a luminous pattern which allows the user to identify in a darker environment. The other portion of the light beams are transmitted to the body part 111 (or the extension part 112) and are reflected between the body part 111 (or the extension part 112) and a second circuit board 230. The light adjusting region 161 defined by the light adjusting structures 16 covers at least a portion of the light emitting unit 133 (i.e., the light adjusting structures 16 are disposed on the transmission path of the light beams), a portion of the light beams can be absorbed by the light adjusting structures 16, and the other portion of the light beams can be scattered by the screen dot structures DP so as to be not centralized, so that the light adjusting structures 16 can effectively reduce the light intensity and concentration degree of the light beams emitted by the light emitting unit 133 so as to correspondingly reduce the light intensity and concentration degree of a portion of the light beams emitted from the gap G and effectively improve the phenomenon of lateral light leakage. Therefore, the luminous key 100 and the keyboard 200 using the luminous key 100 can provide good use experience for users.

It should be noted that herein the following embodiments follow partial contents of the foregoing embodiments, the descriptions of the same technical contents are omitted, the same component names can refer to partial contents of the foregoing embodiments, and the descriptions are omitted in the following embodiments.

FIG. 4A to FIG. 4D are cross-sectional views of luminous keys according to other embodiments of the present invention.

Figure 4A:
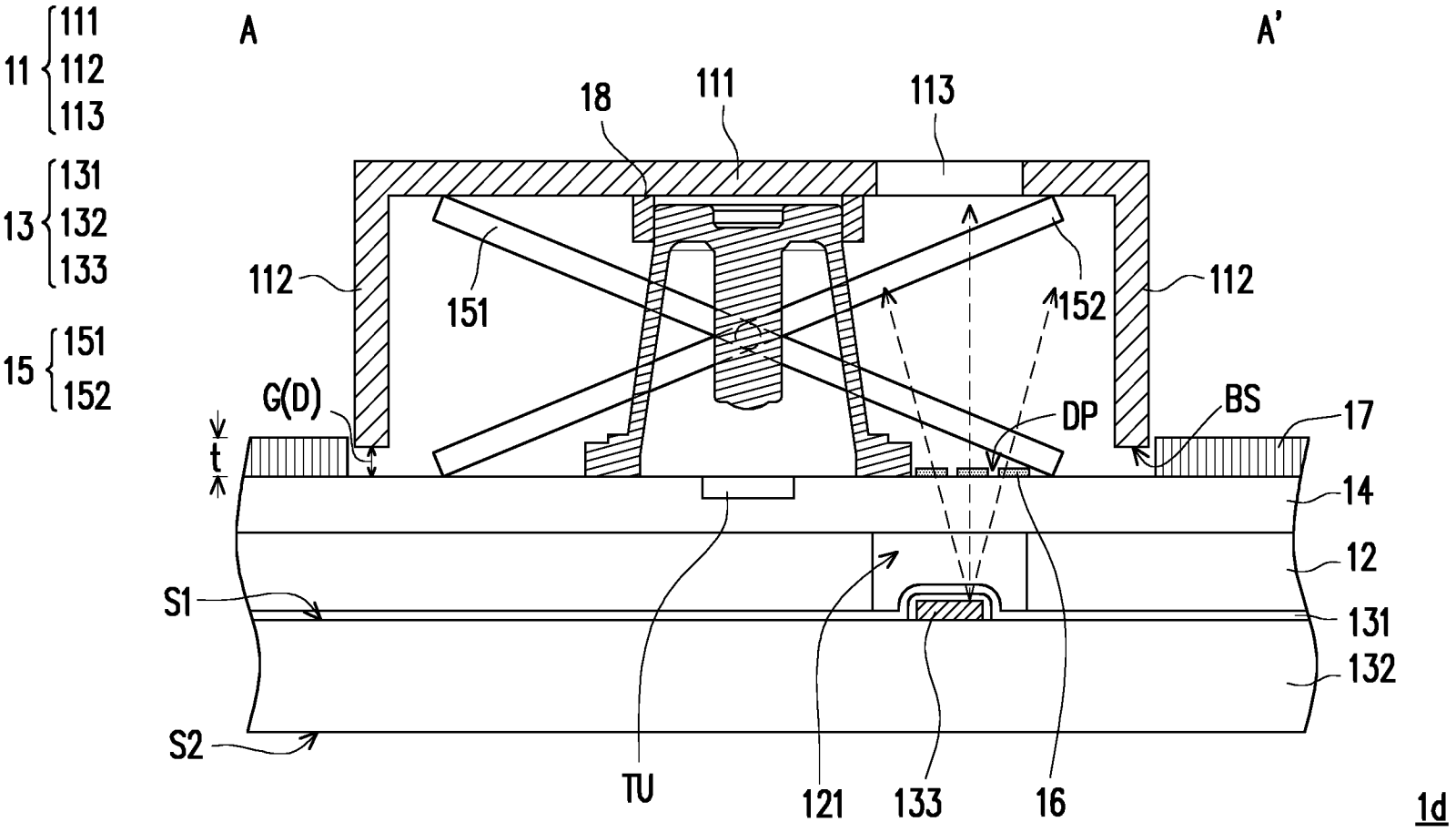
FIG. 4A to FIG. 4D are cross-sectional views of luminous keys according to other embodiments of the present invention.

Referring to FIG. 4A, a luminous key 1*d* is similar to the luminous key 1 in FIG. 2A, and the main difference between the luminous key 1*d* and the luminous key 1 is as follows: the light adjusting structures 16 are disposed on the second circuit component 14 and can be disposed on the upper surface of the second circuit component 14. In other embodiments, similar to the configurations of FIG. 2B to FIG. 2D, the light adjusting structures 16 can be disposed in different positions of the second circuit component 14. For example, the light adjusting structures 16 can be disposed on the lower surface of the second circuit component 14, in the second circuit component 14 or in any combined foregoing position. The present invention is not limited thereto.

Figure 4B:
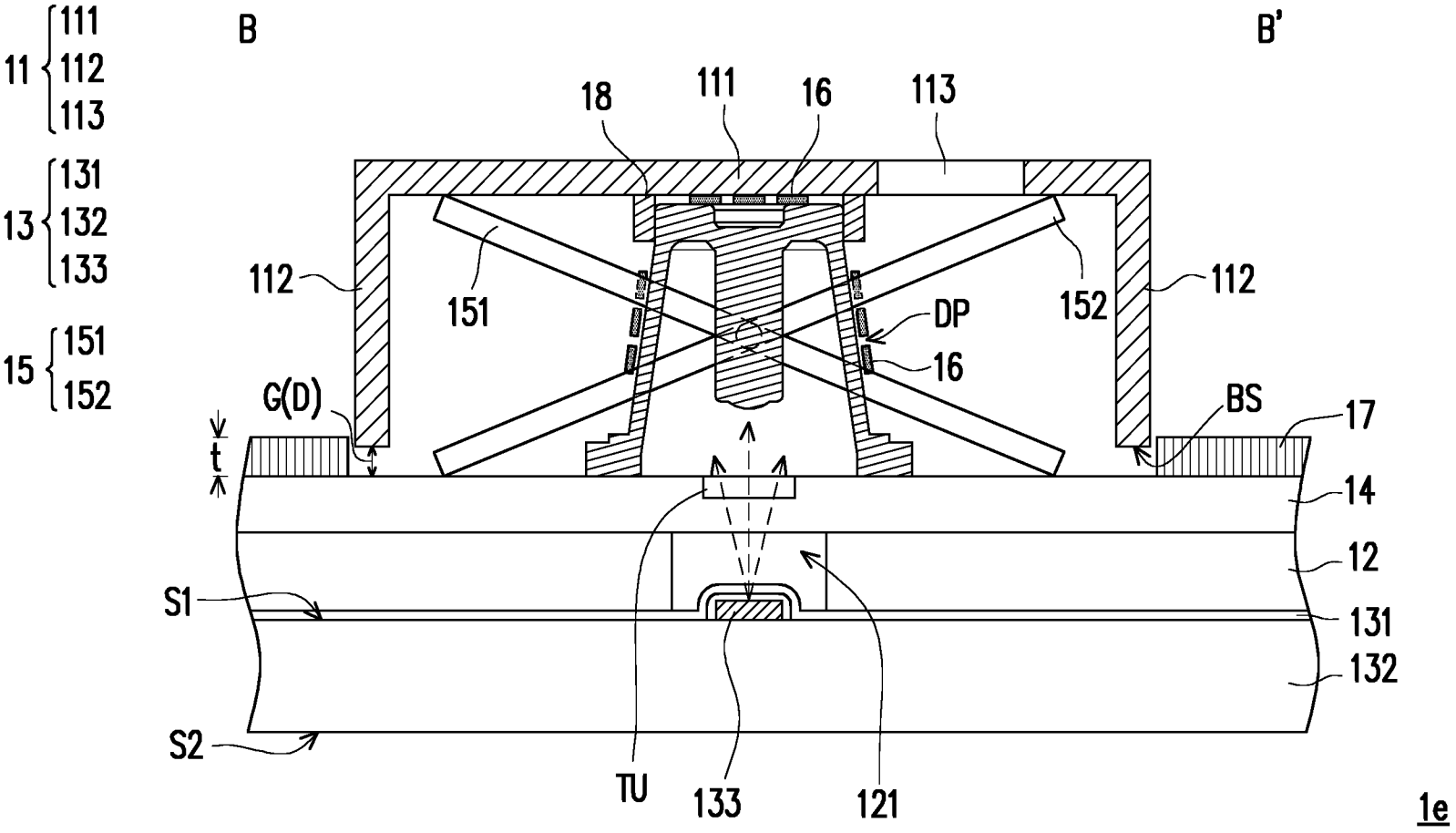

Referring to FIG. 4B in combination of FIG. 1, a luminous key 1*e* is similar to the luminous key 1 in FIG. 2A, and the main difference between the luminous key 1*e* and the luminous key 1 is as follows: a pattern Pe formed by a light exiting part 113*e* can be an English letter W. The light emitting unit 133 is disposed in an orthographic projection range of the elastic part 18 towards the second layer 132, and an orthographic projection of the light exiting part 113 towards the second layer 132 does not cover the light emitting unit 133. The light adjusting structures 16 are disposed on the elastic part 18 and can be disposed on the outer surface of the elastic part 18. In other embodiments, similar to the modes of FIG. 2B to FIG. 2D, the light adjusting structures 16 can be disposed in different positions of the elastic part 18. For example, the light adjusting structures 16 can be disposed on the inner surface of the elastic part 18, in the elastic part 18 or in any combined foregoing position. The present invention is not limited thereto.

In the above embodiment, the light adjusting structures 16 are disposed on any one of the first circuit component 13, the second circuit component 14 and the elastic part 18. In other embodiments, the light adjusting structures 16 can also be disposed in any combined position of the first circuit component 13, the second circuit component 14 and the elastic part 18. The present invention is not limited thereto.

Figure 4C:
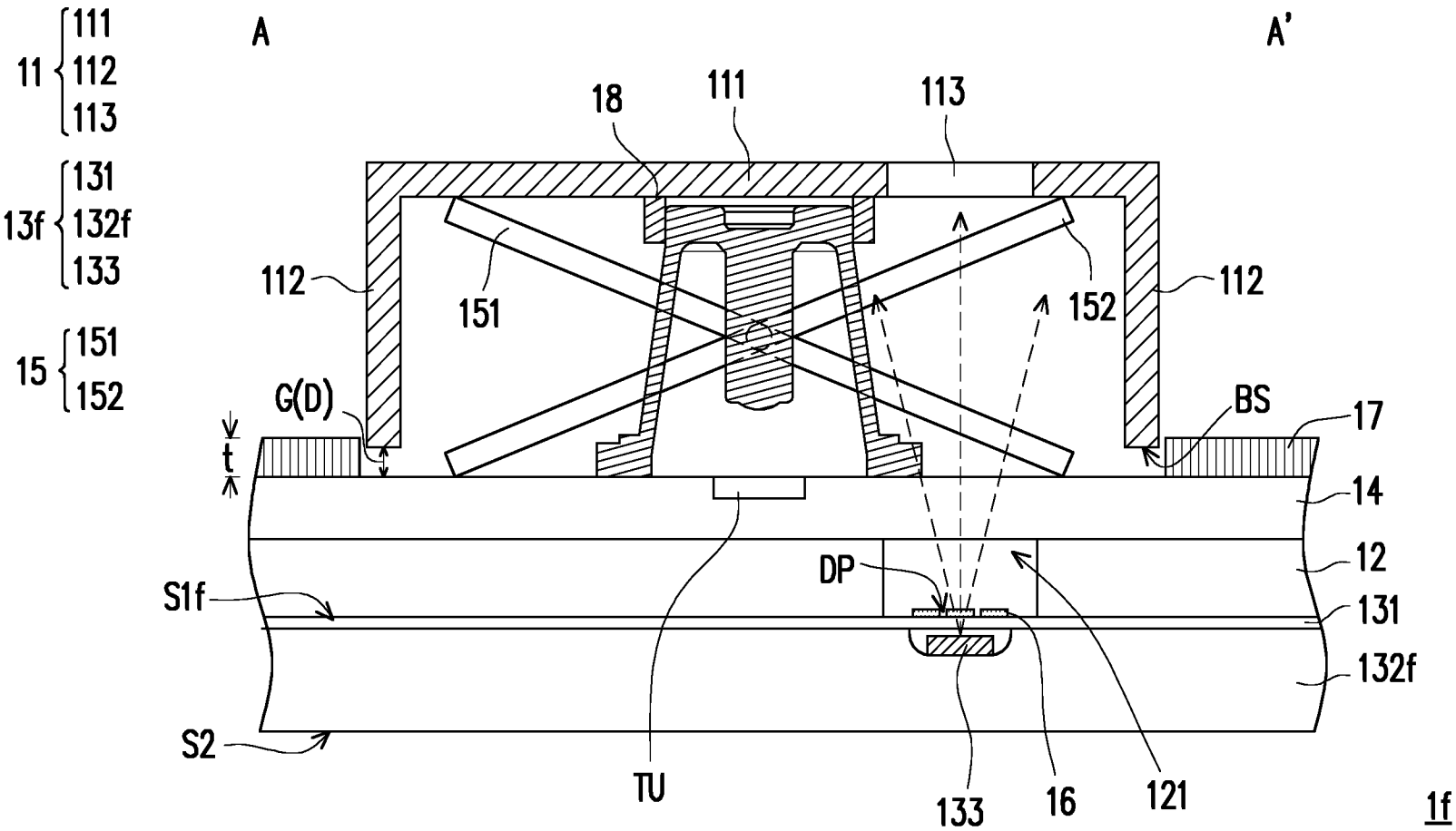

Referring to FIG. 4C, a luminous key 1*f* is similar to the luminous key 1 in FIG. 2A, and the main difference between the luminous key 1*f* and the luminous key 1 is as follows: in a first circuit component 13*f*, a first surface S1*f* of a second layer 132*f* has a concave part CP, and the light emitting unit 133 is disposed in the concave part CP.

Figure 4D:
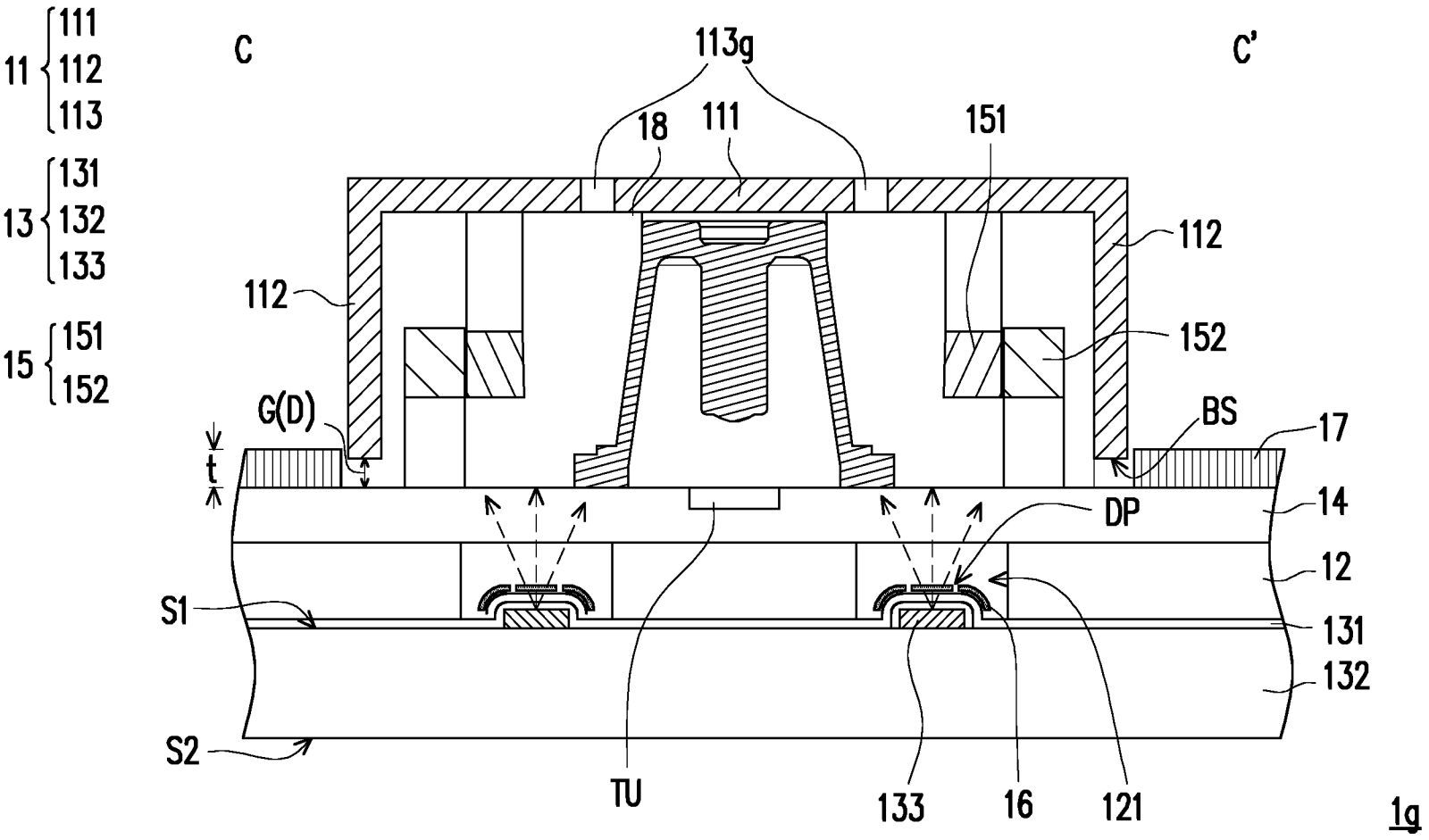

Referring to FIG. 4D in combination of FIG. 1, a luminous key 1*g* is similar to the luminous key 1 in FIG. 2A, and the main difference between the luminous key 1*g* and the luminous key 1 is as follows: the luminous key 1*g* comprises two light emitting units 133 and can also comprise two or more light emitting units in other embodiments. The present invention is not limited thereto. A pattern Pg formed by a light exiting part 113*g* can be an English letter Q. An orthographic projection of the light exiting part 113*g* towards the second layer 132 does not cover the two light emitting units 133.

Furthermore, in the keyboard 200 according to the embodiments of the present invention, the light adjusting structures 16 with different light adjusting capabilities can be designed according to luminous keys 1 in different positions. In detail, because the position of the pattern P formed by the light exiting part 113 on the key cap 11 of each luminous key 1 is different, the uniformity of the light emitted from the luminous keys on the keyboard 200 may be poor. Therefore, before the light adjusting structures 16 are formed on the luminous keys, the brightness of the luminous pattern of each luminous key on which the light adjusting structures 16 are not formed can be firstly measured so as to know the brightness of each luminous key. Then, after the brightness information of the luminous keys on which the light adjusting structures 16 are not formed is known, the light adjusting structures 16 with different light adjusting capabilities can be correspondingly designed in the luminous keys according to the brightness of the emitted light. In detail, if the brightness of a specific luminous key is larger, the light adjusting capabilities (such as dimming capability and scattering capability) of the light adjusting structures 16 formed in the specific luminous key can be designed to be stronger; and if the brightness of a specific luminous key is smaller, the light adjusting capabilities of the light adjusting structures 16 formed in the specific luminous key can be designed to be weaker. Therefore, the characters displayed by the luminous keys 1 of the keyboard 200 according to the embodiments of the present invention can have better light intensity uniformity.

In conclusion, in the luminous key according to the embodiments of the present invention, the plurality of light adjusting structures defines the light adjusting region, and an orthographic projection of the light adjusting region at the second layer covers at least a portion of the light emitting unit, so that the light adjusting structures can effectively reduce the intensity of the light beams emitted by the luminous component so as to correspondingly reduce the intensity of the light beams emitted from gaps and effectively improve the phenomenon of lateral light leakage. Furthermore, the light adjusting structures can also ensure that the light beam with certain intensity is emitted from the light exiting part, and therefore the luminous key and the keyboard according to the embodiments of the present invention can provide good use experience for users.

Furthermore, in the keyboard according to the embodiments of the present invention, light adjusting structures with different light adjusting capabilities can be designed in luminous keys, so that the light uniformity of the luminous patterns emitted by the luminous keys is relatively consistent.

Although the present invention is disclosed above by using the embodiments, the embodiments are not intended to limit the present invention. A person of ordinary skill in the art can make some variations and polishes without departing from the spirit and scope of the present invention. Therefore, the protection scope of the present invention should be subject to the scope of the following claims.

What is claimed is:

1. A luminous key, comprising:

a key cap, comprising a body, an extension part and a light exiting part, wherein the extension part is disposed at a periphery of the body, and the light exiting part is disposed on the body;

a bottom plate, having a through hole;

a first circuit component, having a first layer, a second layer and a light emitting unit, wherein the first layer is disposed between the second layer and the bottom plate, the light emitting unit is disposed between the first layer and the second layer, and the light emitting unit is corresponding to the through hole;

a second circuit component, disposed between the key cap and the bottom plate;

a lifting structure, disposed between the key cap and the bottom plate;

a plurality of light adjusting structures, defining a light adjusting region, wherein an orthographic projection of the light adjusting region towards the second layer covers at least a portion of the light emitting unit, wherein a range of an orthographic projection of the first layer towards the second layer is greater than a range of the orthographic projection of the light adjusting region towards the second layer; and an elastic part, disposed between the key cap and the second circuit component, wherein the light emitting unit is covered by the first layer, the plurality of light adjusting structures are disposed at an upper surface of the first layer, and the first layer is disposed between the light adjusting structures and the light emitting unit.

2. The luminous key according to claim 1, wherein the plurality of light adjusting structures is a plurality of screen dot structures, and the thicknesses of the plurality of screen dot structures are in a range from 3 microns to 30 microns.

3. The luminous key according to claim 1, wherein the orthographic projection of the light exiting part towards the second layer does not cover the light emitting unit.

4. The luminous key according to claim 1, wherein the second layer has a first surface and a second surface which are opposite to each other, the light emitting unit is disposed on the first surface, and an opaque material is disposed on the second surface.

5. The luminous key according to claim 4, wherein the first surface has a concave part, and the light emitting unit is disposed in the concave part.

6. The luminous key according to claim 1, further comprising:

a frame body, disposed on the second circuit component, wherein when the luminous key is not pressed, the distance between a bottom surface of the extension part and the second circuit component is less than or equal to the thickness of the frame body.

7. The luminous key according to claim 6, wherein the light emitting unit is located in an orthographic projection range of the elastic part towards the second layer.

* * * * *